United States Patent [19]

Lehnert

[11] Patent Number: 4,654,564

[45] Date of Patent: Mar. 31, 1987

[54] SATURABLE REACTOR WITH TOROIDAL SHUNT PATHS

[75] Inventor: Stanley E. Lehnert, Addison, Ill.

[73] Assignee: Zenith Electronics Corporation, Glenview, Ill.

[21] Appl. No.: 676,700

[22] Filed: Nov. 30, 1984

[51] Int. Cl.[4] ..... H01J 29/70; H01J 29/76

[52] U.S. Cl. ..... 315/400; 315/371; 336/160

[58] Field of Search ..... 315/400, 371; 336/160

[56] References Cited

U.S. PATENT DOCUMENTS

| | | | |
|---|---|---|---|
| 3,408,535 | 10/1968 | Lemke | 315/400 |
| 3,444,422 | 5/1969 | Wolber | 315/24 |
| 3,940,662 | 2/1976 | Quirke | 315/400 |
| 3,944,884 | 3/1976 | Wilocki | 315/400 |
| 3,990,030 | 11/1976 | Chamberlin | 336/65 |
| 4,146,859 | 3/1979 | Quirke | 336/110 |

*Primary Examiner*—Theodore M. Blum

[57] ABSTRACT

A saturable reactor has a center control winding electromagnetically coupled to a pair of outer windings which, in turn, are each coupled in circuit with a respective toroidal shunt winding. The reactor provides side pincushion correction and eliminates center pinch in a raster scanned video display such as a cathode ray tube (CRT). The high inductance-to-resistance ratios of the toroidal windings as well as the shunt current paths permit increased deflection current to be provided to the horizontal deflection coils without saturating the reactor or requiring an increase in its size.

8 Claims, 3 Drawing Figures

L
"X"
I
TOP
V
BOTTOM
H

70
HORIZONTAL STAGE
64
68
66
62
V1
58
72
12
56
VERTICAL DEFLECTION AMPLIFIER
54
52
26
16
60
28
14
24

SATURABLE REACTOR WITH TOROIDAL SHUNT PATHS

BACKGROUND OF THE INVENTION

This invention relates generally to the control of the deflection of an electron beam in general and is particularly directed to an arrangement for providing horizontal pincushion correction for an electron beam in a raster scanned video display such as a cathode ray tube (CRT).

In deflecting an electron beam in a CRT such as a television receiver picture tube, errors arising from the geometry of the faceplate of the tube and the electron optics of the scanned beam result in pincushion distortion wherein an image appearing on the CRT's faceplate has inwardly curved top, bottom and lateral edges with the image subjected to a corresponding inwardly compressed distortion. This distortion arising from an angularly displaced beam incident upon a generally flat screen is normally corrected by appropriate adjustment of the horizontal and vertical electron beam deflection signals provided to the CRT.

Horizontal deflection control circuitry typically includes a saturable reactor for controlling or modulating the horizontal deflection current supplied to the horizontal deflection yoke of the CRT by a flyback transformer. In particular, the necessary control is effected by the horizontal deflection current in a parabolic manner so as to maximize its amplitude at the middle of each vertical scanning period and minimize its value at the top and bottom edges of the scanning period.

Pincushion distortion is known to increase with increasingly wider deflection angles of the CRT and is thus most pronounced in axially short CRT's with relatively flat screens. To compensate for the increased pincushion distortion experienced in the wide angle, shorter CRT's, the tendency is to provide increased control over the electron beam deflection current via the saturable reactor. The danger here, however, is that the core of the reactor will become saturated during the peaks of the parabolically-controlled deflection current and that control over electron beam deflection will thus be limited. The conventional approach for overcoming this problem has been to increase the size of the saturable reactor to accommodate the larger deflection currents. However, increasing the size of the saturable reactor is, of course, limited by the available space in the chassis in which the CRT is positioned as well as cost considerations. In addition, it is desirable to minimize the magnetic fields generated by the current within electromagnetic devices in electronic apparatus for reduced shielding requirements.

The prior art discloses various attempts to provide optimum electron beam control in correcting for pincushion distortion without saturating the reactor. U.S. Pat. Nos. 3,940,662 and 4,146,859 to Quirke disclose a saturable reactor device including a control coil having a current of one frequency therein, a load coil through which a current of a different frequency flows and which latter current is to be modified by the current through the control coil, and a saturable core upon which both coils are wound in an arrangement wherein the single wire windings need not be connected with one another and each winding can be wound apart from its core on bobbins that can be readily assembled axially onto the core. U.S. Pat. No. 3,444,422 to Wolber discloses a single two-window saturable reactor having a first winding connected in parallel with the horizontal deflection coil and a second winding connected in series with the vertical deflection coil and a frame deflection generator. The frame deflection current flowing in the second winding varies the inductance of the first winding so as to correct the side-to-side pincushion distortion. By phase shifting the voltage in the second winding applied to the vertical deflection coil, top-to-bottom pincushion is also corrected.

U.S. Pat. No. 3,990,030 to Chamberlin discloses a single pincushion correction transformer for both vertical and horizontal correction which includes an E core having a control winding provided around the central leg, a horizontal correction winding provided on one outer leg, and a pair of phase opposed windings on the other leg to minimize cross modulation and sensitivity to stray magnetic fields. U.S. Pat. No. 3,944,884 to Wilocki discloses a pincushion correction circuit including either a single adjustment control to adjust the correction at the beginning and end of scan or a pair of independent controls for correction at the beginning and end of scan, respectively. Each adjustment is provided by a variable inductor having a movable core, with a diode switching network switching the correction circuit to the particular variable inductor which is to control the adjustment at either the beginning or the end of scan. U.S. Pat. No. 3,854,108 to Horie et al discloses a saturable reactor having a magnetic core with right and left half portions symmetrical to one another and a center branched portion defining an air gap between one end of itself and the right and left half portions. First and second pairs of windings are coupled to the right and left half portions in series and parallel arrangements, respectively, in order to prevent saturation of the core.

The present invention represents an improvement over prior art saturable reactors of the type having a control winding responsive to a vertical rate parabolic control signal for correspondingly modulating the inductance of and the horizontal deflection current conducted by at least one secondary winding for providing side pincushion correction. In particular, a circuit is disclosed for preventing saturation of the reactor to allow for adequate control of the horizontal deflection current. This approach provides a low cost, efficient arrangement for pincushion correction which does not necessitate an increase in the size of the saturable reactor or involve an increase in the magnitude of the electromagnetic fields produced therein.

OBJECTS OF THE INVENTION

Accordingly, it is an object of the present invention to provide improved control of the deflection of an electron beam in a raster scanned CRT.

It is another object of the present invention to provide an arrangement for operating a saturable reactor at increased current without either driving the reactor's core into saturation or increasing the intensity of the magnetic fields thus produced by the reactor.

A further object of the present invention is to provide pincushion correction for an electron beam in a CRT using a conventional saturable reactor without increasing either its size or cost.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
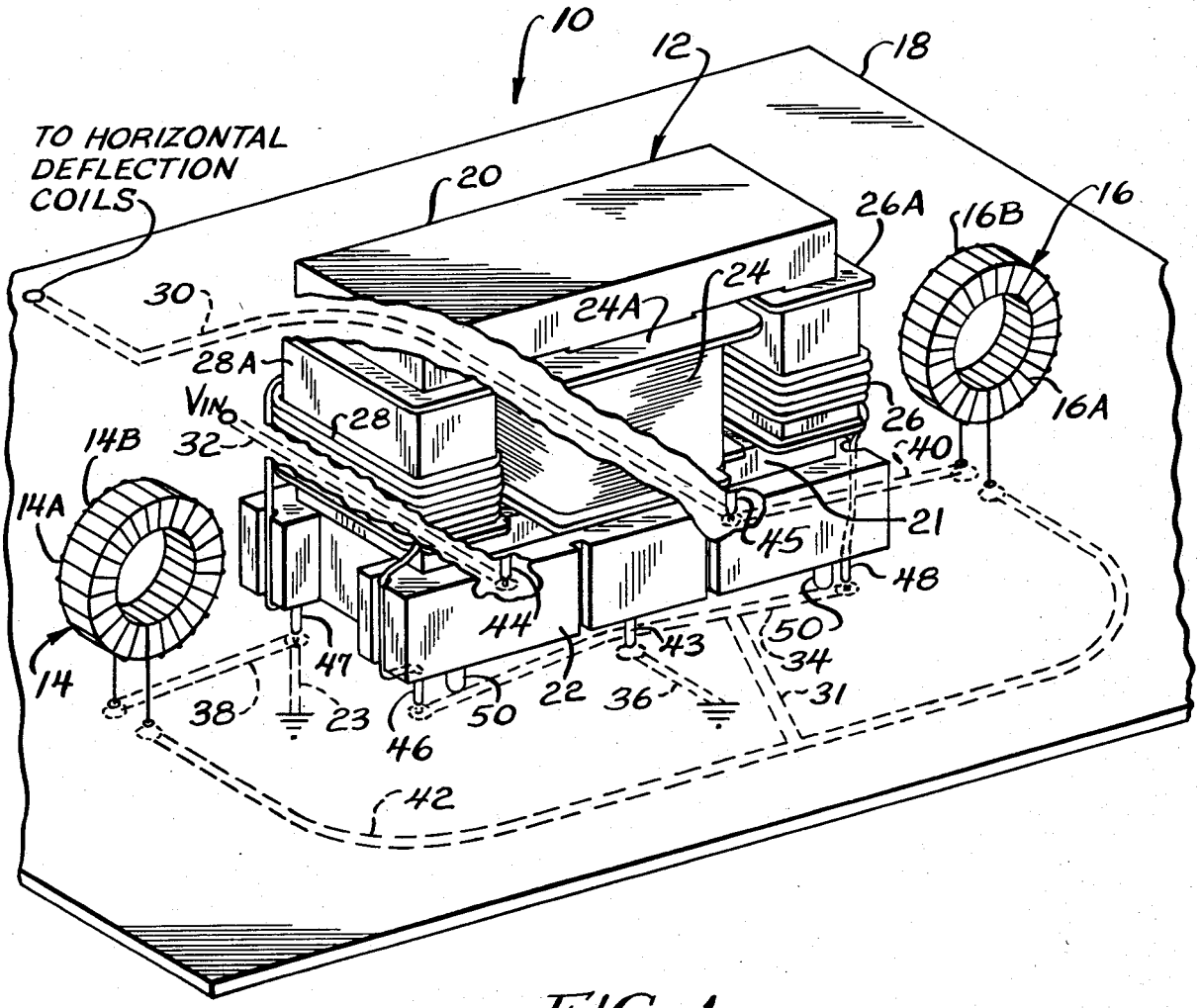
FIG. 1 is a partially cutaway perspective view of a saturable reactor with toroidal shunt paths positioned on a circuit board and coupled to conductors thereon in accordance with the present invention.

Referring to FIG. 1, there is shown a partially cutaway upper perspective view of a saturable reactor with toroidal shunt paths 10 positioned upon a circuit board 18 in accordance with the present invention.

The saturable reactor with toroidal shunt paths 10 includes a reactor 12 coupled in circuit with first and second shunt toroids 16, 14. The reactor 12 includes an E core having an upper leg 20 and a parallel lower leg 21. Positioned in spaced relation from one another and between the upper and lower legs 20, 21 are a center, primary bobbin 24A and two outer, secondary bobbins 26A, 28A symmetrically positioned on respective sides of the primary bobbin 24A and in spaced relation with respect thereto. Positoned within the primary bobbin 24A and the two secondary bobbins 26A, 28A are a center leg and first and second outer legs, respectively. These legs, none of which are shown in FIG. 1, provide support as well as a symmetrical magnetic structure for the reactor 12. The reactor 12 is securely positioned upon a base 22 which, in turn, is provided with a plurality of inserts 50 on a lower portion thereof for insertion within corresponding apertures (not shown) in the circuit board 18. The base 22 and associated inserts 50 provide a stable mounting platform for the reactor 12 upon the circuit board 18.

A control winding 24 is wound around and positioned upon the primary bobbin 24A and is coupled via leads 43 and 44 to foil conductors 36 and 32, respectively. Conductor 32 is coupled to a vertical deflection amplifier (not shown in FIG. 1) from which an input signal having a suitably shaped waveform is received so as to provide a parabolic current through the saturable reactor control winding 24. Conductor 36 is coupled to neutral ground potential.

Wound around the first and secondary bobbins 26A, 28A are first and second serially connected outer windings 26, 28, respectively, which conduct the horizontal deflection current. One end of the first outer winding 26 is coupled via lead 45 to a conductor 30. Conductor 30 is, in turn, coupled to horizontal deflection coils (not shown in FIG. 1). The first outer winding 26 is further coupled via lead 45 and conductor 40 to the first shunt toroid 16. The other end of the first outer winding 26 is coupled via lead 48, conductor 34 and lead 46 to the second outer winding 28. Similarly, the other end of the second outer winding 28 is coupled via a lead 47 and conductor 38 to the second shunt toroid 14. The second outer winding 28 is further coupled via lead 47 and conductor 23 to neutral ground potential as is one end of the second shunt toroid 14. The first and second shunt toroids 16, 14 are further coupled in series by means of conductor 42, with the combination of the first and second shunt toroids coupled in parallel with the combination of serially coupled first and second outer windings 26, 28 by means of conductor 31. Each of the respective first and second shunt toroids 16, 14 is comprised of the combination of a shunt winding 16A, 14A and a core 16B, 14B comprised of a material having a high magnetic permeability such as powdered iron or a ceramic material.

Figure 2:
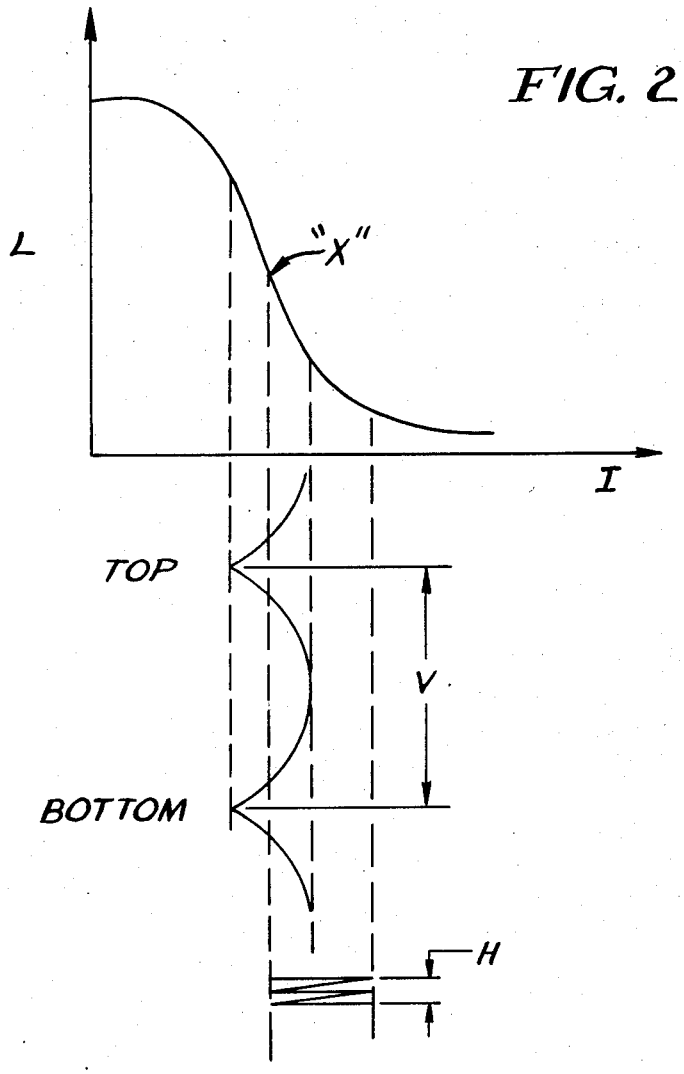
FIG. 2 illustrates the transfer curve, or the variation of inductance with current, as well as the variation of other operating parameters in the saturable reactor with toroidal shunt paths shown in FIG. 1 during electron beam horizontal sweep of the CRT's faceplate.
Figure 3:
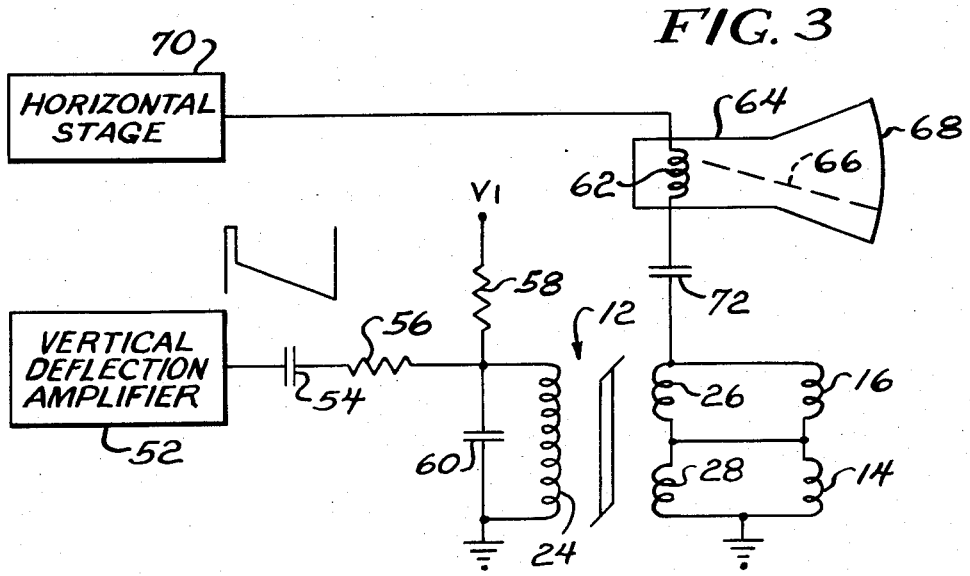
FIG. 3 is a simplified combined block and schematic diagram of a system incorporating the saturable reactor with toroidal shunt paths of the present invention.

Referring to FIGS. 2 and 3, the operating characteristics of the saturable reactor with toroidal shunt paths 10 will now be described in detail. An input signal is provided from a vertical deflection amplifier 52 for controlling the saturable reactor circuit. The waveform of the signal provided from the vertical deflection amplifier 52 to the saturable reactor circuit 10 is generally of a trapezoidal shape. This input signal is provided through a capacitor 54 to an integrator circuit comprised of a resistor 56 and a capacitor 60 to provide a parabolic control current through the saturable reactor control winding 24. Horizontal deflection current is provided by a horizontal stage 70 which typically includes a flyback transformer. The deflection current is provided to the horizontal deflection coils 62 of a CRT 64 for horizontally deflecting an electron beam 66 across the CRT's faceplate 68 and therefrom to the outer windings 26, 28 through a capacitor 72.

The transfer curve of the saturable reactor 10 is shown in terms of its inductance (L) and the current (I) in the reactor in the upper portion of FIG. 2. The operating point along the transfer curve of the saturable reactor is determined by the DC current flowing through the center control winding 24 and is established by the V1 DC bias voltage applied across the control winding 24 and the value of resistor 58. The saturable reactor operating point is normally set at the midpoint of the linear portion of the transfer curve for the saturable reactor indicated as point "X" in FIG. 2. The inductance values of the transfer curve shown in the upper portion of FIG. 2 are for the first and second outer leg windings 26, 28 and are depicted for typical input control signals and V1 biasing voltage values. From the intermediate portion of FIG. 2, it can thus be seen that the inductance of the first and second outer leg windings 26, 28 varies in a parabolic manner during the vertical scanning interval where V represents a single vertical scan of the CRT's faceplate. Thus, the inductance of the first and second outer leg windings 26, 28 is a maximum at the top and bottom of the scanned raster and a minimum in the center, or mid-position, of the raster. This variable inductance characteristic of the saturable reactor 12 appropriately modulates the deflection current derived from horizontal stage 70 and flowing through the horizontal deflection coils 62 to compensate for side pincushion distortion of the scanned raster.

The variation of current through the outer windings 26, 28 with horizontal sweep (H) is shown at the bottom of FIG. 2. The deflection current passing through the outer windings and the horizontal deflection coils 62 is minimum at the center of the raster and maximum at the lateral edges thereof. These current peaks tend to drive the reactor into saturation at the beginning and end of horizontal sweep causing increased scan width at the raster extremities and center pinch distortion.

Prior art systems which do not include shunt toroids 16, 14 provide the entire deflection current through the horizontal deflection coils 62 and the first and second outer windings 26, 28 which are serially coupled thereto. This current, typically of several amperes peak-to-peak in a saturable reactor having a turn count in the outer leg windings generally less than 10, results in a rather high ampere turn situation. In addition, with increasing use of line operated DC power supplies such as in many television receivers, a maximum of 95 VDC is typically available for the horizontal output circuit whereas in earlier systems DC voltages on the order of 145 volts were available. This reduction in the available DC voltage in combination with the aforementioned increased electron beam deflection angles, e.g., typically on the order of 100 degrees, has necessitated the use of lower inductance horizontal deflection coils requiring a corresponding increase in the peak-to-peak amplitude of the horizontal deflection current. As a result, horizontal peak-to-peak deflection coil currents on the order of 8 amperes are becoming commonplace. Currents of this magnitude substantially increase the tendency to drive the reactor into saturation.

The ever increasing deflection coil currents passing through the outer leg windings 26, 28 of the saturable reactor 12 result in the operation of the saturable reactor on the lower end of the transfer curve shown in the upper portion of FIG. 2. The increasing horizontal deflection current eventually drives the saturable reactor into the core saturation region, particularly during the peaks of the horizontal deflection current resulting in degraded saturable reactor performance exhibited as horizontal center pinch, or compression, in the raster scanned display. The prior art typically solved this problem by increasing the size of the saturable reactor in order to increase the cross sectional area of the magnetic flux path and thereby increase the magnetic saturation point of the reactor's core. But as previously discussed, this solution is frequently not possible and even if physically possible, does not represent an economically feasible solution to the problem.

The present invention avoids the aforementioned core saturation problem and associated horizontal center pinch in the raster scanned display without increasing the size of the saturable reactor, while still allowing for the use of increased horizontal deflection currents which are corrected for side pincushion distortion. In particular, the first and second toroids 16, 14 are coupled in series with respect to one another and are respectively coupled in parallel across the first and second outer leg windings 26, 28. The first and second shunt toroids 14, 16 preferably possess high inductance and low DC resistance and are each in the form of a conductor wound around a high permeability material which is shaped in the form of a toroid.

The first and second shunt toroids 16, 14 provide a balanced arrangement across the first and second outer leg windings 26, 28 and provide an efficient means for bypassing or shunting deflection current around the outer leg windings so as to avoid saturation of the reactor 12 thus enabling the use of a large deflection current for driving the horizontal deflection coils 62. That is, the deflection current flowing through deflection coils 62 is split between the pincushion correcting outer windings 26, 28 and the toroids 14, 16 in accordance with the ratio of their inductances. In addition, the closed winding arrangement around the highly permeable toroidally shaped cores provides high inductance for retaining the pincushion correcting characteristics of the saturable reactor 12. Because of the high L/R ratio provided by the shunt toroids, horizontal deflection currents as high as 8 amperes peak-to-peak may be controlled in the horizontal deflection coils 62 without saturating the reactor 12 and without the appearance of center pinch in the raster scanned video display. In a preferred embodiment, the inductance of each of the first and second outer leg windings 26, 28 is set to approximately twice the normal value, with equal shunting inductance provided by each of the first and second shunt toroids 16, 14.

There has thus been shown a saturable reactor with toroidal shunt paths which permits large controlled currents to be provided to the horizontal deflection coils of a raster scanned video display without saturating the reactor and producing center pinch distortion in the displayed image. The present invention thus provides improved control of the horizontal deflection coils without increasing the cost or size of the saturable reactor which provides the control therefor.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. In a raster scanned video display having means for establishing a horizontal rate deflection current in a horizontal deflection coil and means for providing a vertical rate parabolically shaped side pincushion correcting control signal, the improvement comprising:

a saturable reactor having a control winding responsive to the control signal for producing a corresponding magnetic field and a secondary winding magnetically coupled to the control winding such that its inductance varies in accordance with the control signal;

means coupling the secondary winding of the reactor in series with the horizontal deflection coil for modulating the horizontal deflection current for correcting side pincushion distortion in the video display; and inductive means coupled in series with the horizontal deflection coil and in circuit with the secondary winding for shunting a portion of the horizontal deflection current around the secondary winding so as to prevent said reactor from saturating.

2. In a raster scanned video display having means for establishing a horizontal rate deflection current in a horizontal deflection coil and means for providing a vertical rate parabolically shaped side pincushion correcting control signal, the improvement comprising:

a saturable reactor having a control winding responsive to the control signal for producing a corresponding magnetic field and a secondary winding magnetically coupled to the control winding such that its inductance varies in accordance with the control signal;

means coupling the secondary winding of the reactor in series with the horizontal deflection coil for modulating the horizontal deflection current for correcting side pincushion distortion in the video display; and third winding wrapped around a toroidal-shaped magnetic permeable core and coupled in series with the horizontal deflection coil, the third winding being coupled in circuit with the secondary winding for shunting a portion of the horizontal deflection current around the secondary winding so as to prevent said reactor from saturating.

3. The improvement of claim 2 wherein said third winding is characterized by a relatively high inductance-to-resistance ratio for permitting the flow of increased deflection current in the horizontal deflection.

4. In a raster scanned video display having means for establishing a horizontal rate deflection current in a horizontal deflection coil and means for providing a vertical rate parabolically shaped side pincushion correcting control signal, the improvement comprising:

a saturable reactor having a first center leg and second and third outer legs symmetrically connected in a magnetic circuit;

a first control winding positioned on said first center leg and responsive to the control signal for producing a corresponding magnetic field;

second and third series connected outer windings respectively positioned on the second and third outer legs and magnetically coupled to the control winding such that their inductances vary in accordance with the control signal;

means coupling the second and third outer windings in series with the horizontal deflection coil for modulating the horizontal deflection current for correcting side pincushion distortion in the video display; and fourth and fifth windings coupled in series with the horizontal deflection coil and respectively coupled in parallel across the second and third outer windings for shunting a portion of the horizontal deflection current around the second and third windings so as to prevent said reactor from saturating.

5. The improvement of claim 4 wherein said fourth and fifth windings have high inductance-to-resistance ratios for permitting the flow of increased deflection current in the horizontal deflection coil.

6. The improvement of claim 5 wherein the fourth and fifth windings are wrapped around respective toroidal-shaped magnetic permeable cores.

7. The improvement of claim 6 wherein the toroidal-shaped magnetic permeable cores are comprised of powdered iron.

8. The improvement of claim 6 wherein the toroidal-shaped magnetic permeable cores are comprised of a ceramic material.

* * * * *